United States Patent [19]

Izraeli

[11] 4,170,154

[45] Oct. 9, 1979

[54] FULL STROKE COMPELLING MECHANISM

[75] Inventor: Hyman Izraeli, West Caldwell, N.J.

[73] Assignee: Thomas & Betts Corporation, Raritan, N.J.

[21] Appl. No.: 858,075

[22] Filed: Dec. 6, 1977

[51] Int. Cl.[2] ..... B25B 7/02

[52] U.S. Cl. ..... 81/313

[58] Field of Search ..... 81/313, 134, 137–140; 254/111; 194/DIG. 12; 72/416, 410; 74/575, 577 R, 578, 17.5

[56] References Cited

U.S. PATENT DOCUMENTS

| | | | |
|---|---|---|---|
| 2,088,054 | 7/1937 | Crosman | 74/17.5 |
| 3,039,337 | 6/1962 | Stuart-Prince | 81/313 |
| 3,277,751 | 10/1966 | Filia | 81/313 |

FOREIGN PATENT DOCUMENTS

| | | | |
|---|---|---|---|
| 2722299 | 12/1977 | Fed. Rep. of Germany | 72/410 |

*Primary Examiner*—James L. Jones, Jr.
*Attorney, Agent, or Firm*—David Teschner

[57] ABSTRACT

The pawl means portion of a pawl and ratchet type full stroke compelling mechanism for use preferably in hand tools and the like is arranged for translatable movement towards and away from the ratchet means of the mechanism to permit a reversal of the direction of movement of the handles of the tool prior to full opening while recommitting the device to a full closure stroke from the point of reversal, thereby avoiding the necessity for requiring the handles of the tool to be opened to their fully open position before closure can again be reinstituted.

8 Claims, 10 Drawing Figures

FULL STROKE COMPELLING MECHANISM

BACKGROUND OF THE INVENTION

1. Field of the Invention

The invention is directed to the field of closure mechanisms for hand tools and the like and principally to an improved full stroke compelling mechanism.

2. Description of the Prior Art

Various forms of mechanisms for hand tools and the like which require the user to complete the jaw closing stroke of the tool before the handles may be moved in a reverse direction are well known in the prior art. Examples of such mechanisms are disclosed in U.S. Pat. No. 2,696,747 issued Dec. 14, 1954 to M. D. Bergan; U.S. Pat. No. 2,784,621 issued Mar. 12, 1957 to M. L. Klinger; U.S. Pat. No. 3,262,342 issued July 26, 1966 to G. J. Filia; and U.S. Pat. No. 3,406,558 issued Oct. 22, 1968 to H. P. G. Tillmann et al. Each of these mechanisms comprise essentially a pawl and ratchet arrangement wherein the pawl is selectively inclined in one of two positions according to the direction of travel of the handle portions of the tool, the reversal of inclination of the pawl means being accomplished by release means located at either end of the ratchet means of the mechanism. In each case, however, the pawl and ratchet combination operates as a restriction on the reversal of movement of the handle portion in both directions of movement, that is, in both the closing and opening stroke of the tool so that once full closure is accomplished the handles must be brought to their fully opened position before the closing stroke may be reinstituted. An arrangement designed to at least partially overcome the above limitation is disclosed in U.S. Pat. No. 3,039,337 issued June 19, 1962 to R. G. Stuart-Prince. This device is shown to include a spring biased ratchet which is movable out of engagement with the opening portion of the tool stroke to permit the closure stroke to be reinstituted prior to completion of the opening stroke. The disclosed mechanism, however, involves an expensive and complex arrangement of parts composed of interfitting and sliding mechanisms which may be easily damaged in handling and use.

SUMMARY OF THE INVENTION

The invention overcomes the limitations and difficulties noted above with respect to prior art devices by providing a simple and inexpensive improved full stroke compelling mechanism for hand tools and the like which automatically senses reversal of force exerted on the handles of the tool during the opening stroke to permit the user to reengage the tool into the closing stroke and reinitiate the full stroke compelling mechanism at any desired point in the opening stroke of the tool, thus avoiding the necessity for completing the opening stroke before reversal can be accomplished. The pawl portion of the pawl and ratchet mechanism is mounted upon a pivot which is selectively movable in a slot adapted to support and guide the pawl so that the pawl may be shifted along a predetermined path towards and away from the ratchet means. The pawl movement is controlled in such manner as to permit it to shift angularly with respect to a predetermined axis so as to reengage the ratchet means in a position intended to insure that the closure stroke is again completed before the tool handles may be reopened. Thus, the necessity for bringing the handles of the tool to a fully opened position before closure may be reinstituted is avoided whereby the user may use relatively shorter strokes to accomplish the jaw closure operation. It is there an object of this invention to provide an improved full stroke compelling mechanism for a hand tool or the like.

It is another object of this invention to provide a shiftable pawl member in a full stroke compelling mechanism.

It is a further object of this invention to provide a modified full stroke compelling mechanism which permits the user to reverse the direction of stroke during the opening stroke of a hand tool and to reengage the full stroke compelling mechanism.

It is still another object of this invention to permit the user of a hand tool having a full stroke compelling mechanism to advantageously use such tool in relatively confined spaces.

It is still a further object of this invention to provide a full stroke compelling mechanism in a hand tool or the like in which the pawl means may be angularly shifted prior to the full open position of the handles of the tool in response to a predetermined direction of movement of the ratchet means.

Other objects and features of the invention will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings

Similar elements are given similar reference characters in each of the respective drawings.

DESCRIPTION OF THE PREFERRED EMBODIMENTS

Figure 2:
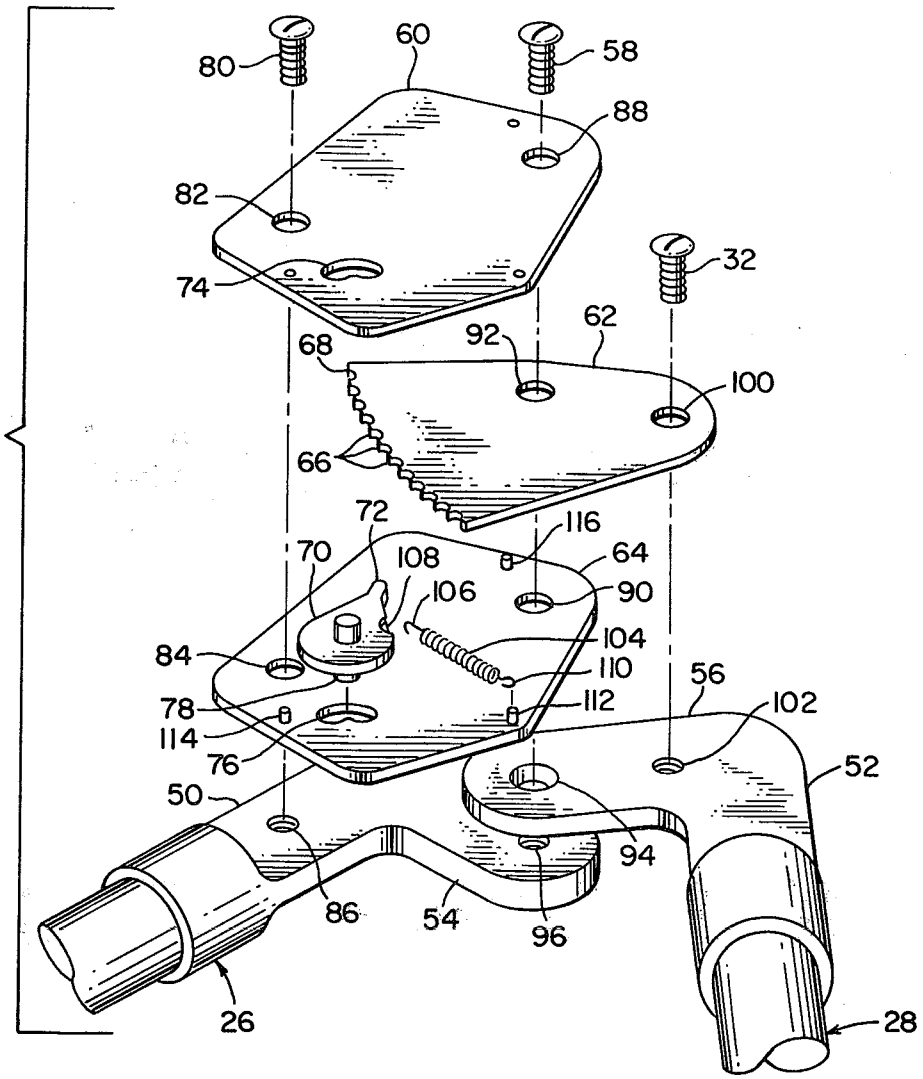
FIG. 2 is a fragmentary exploded perspective view showing the various parts of the device of FIG. 1.
Figure 1:
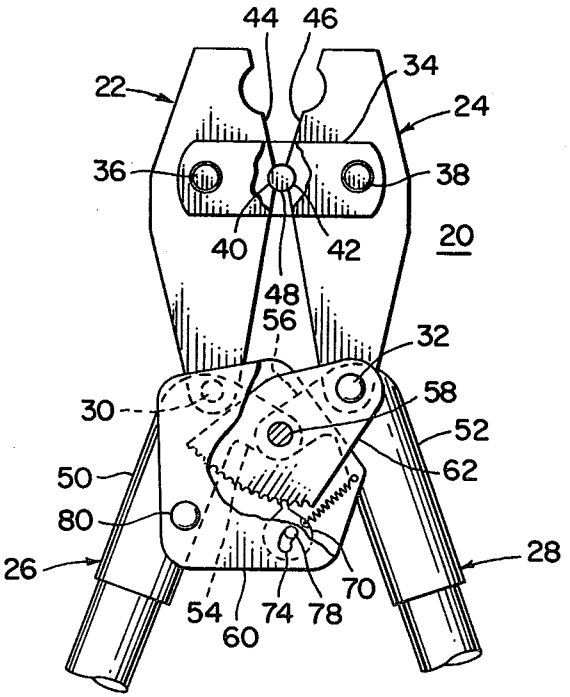
FIG. 1 is a fragmentary plan view, partially in section, of a hand tool employing a full stroke compelling mechanism constructed in accordance with the concepts of the invention.

Turning now to FIGS. 1 through 7 there is shown a fragmented view of a tool 20 (FIG. 1) comprising a pair of jaw means 22 and 24 which are driven by a pair of handle means 26 and 28 and coupled thereto by respective pivot pins 30 and 32. The jaw means 22 and 24 are coupled together by a link member 34 which is coupled to jaw means 22 by a pin 36 and to jaw means 24 by a pin 38. Each of the jaw means 22 and 24 is provided with an arcuate recess 40, 42, along its inner edge 44, 46, respectively, which is arranged to slidingly bear against a fulcrum pin 48. The handle means 26 and 28 each comprises a head portion 50, 52, respectively, which is provided with an extending finger portion 54, 56, respectively, the finger portions 54 and 56 being pivotally joined to one another by a pin 58, which extends through an upper support plate 60 (FIG. 2), a ratchet means 62, a lower support plate 64, and the two finger portions 56 and 54. The ratchet means 62 is located between the upper and lower support plates 60 and 64, respectively, and pivots about the pin 58. The ratchet means 62 is provided with a series of ratchet teeth 66 extending along an arcuate edge 68 of the ratchet means 62 and arranged for engagement with a pawl means 70 having a nose portion 72 arranged to mate with the teeth 66 of the ratchet means 62. Each of the support plates 60 and 64 is provided with a slotted opening 74, 76, respectively, which serves as a bearing for a pivot pin 78 extending transversely through the pawl means 70. The support plates 60 and 64 are further coupled to one another by a pin 80 extending through transverse openings 82 and 84 of plates 60 and 64, respectively. The pin 80 is also employed to couple the support plates 60 and 64 to the head portion 50 of handle means 26. This is accomplished by providing a pin receiving opening 86 in the head portion 50 and and permitting the pin 80 to extend therethrough. The support plates 60 and 64 are also coupled together by pin 58 which extends through pin receiving openings 88 and 90 in plates 60 and 64, respectively, and through an opening 92 in the ratchet means 62. The ratchet means 62 and the support plates 60 and 64 are further coupled to the finger portions 56 and 54 of the respective handle means 28 and 26 by the extension of pin 56 through transverse openings 94 and 96 in the respective finger portions 56 and 54. The ratchet means 62 pivots about the pin 58 and is driven by the handle means 28 by means of a coupling comprising the pin 32 extending through a transverse opening 100 in ratchet means 62 and through a transverse opening 102 in the head portion 52 of handle means 28 whereby, upon movement of the handle means 28, the ratchet means 62 is caused to move in response thereto about the pivot pin 58. The teeth 66 of the ratchet means 62 are thus caused to traverse an arcuate path having a constant radius of curvature about a central axis passing through the opening 92 and coincident with the openings 94 and 96 in the respective finger portions 56 and 54. The pawl means 70 is biased in a clockwise direction, as viewed in FIG. 1, by biasing means shown, by way of example, as an extension spring 104 having a hooked first end 106 which engages a small opening 108 in the pawl means 70, and a hooked second end 110 which engages a spacer pin 112 coupled to the lower support plate 64. Additional spacer pins 114 and 116 extending from the lower support plate 64 cooperate with spacer pin 112 to provide a support for support plate 60 and to maintain plates 60 and 64 in a predetermined spaced relationship to permit free movement of the ratchet means 62 and the pawl means 70 therebetween.

Figure 3:
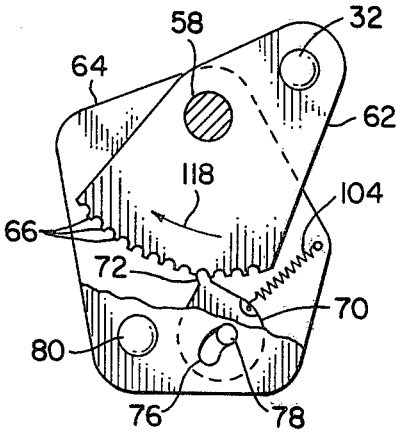
FIG. 3 is a plan view, partly cut away and partly in section, of the full stroke compelling mechanism of the device of FIG. 1 in a first phase of operation.
Figure 4:
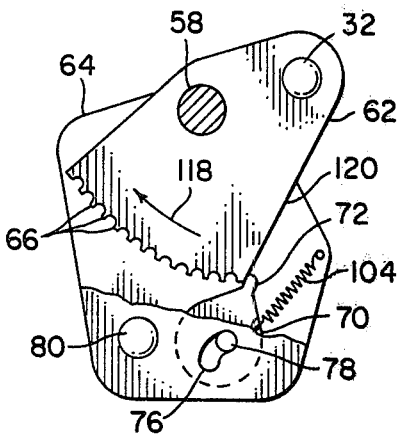
FIG. 4 is a plan view, partly cut away and partly in section, of the full stroke compelling mechanism of the device of FIG. 1 at a further point in the operation thereof.
Figure 5:
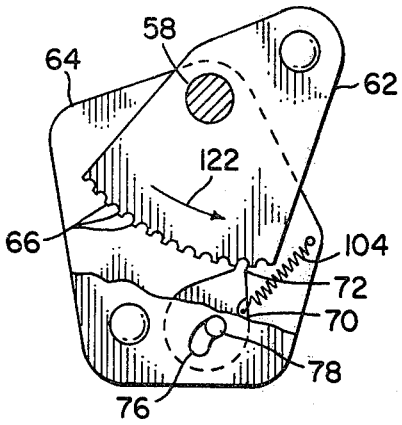
FIG. 5 is a plan view, partly cut away and partly in section, of the full stroke compelling mechanism of the device of FIG. 1 showing the relationship of the parts therein in a further phase of the operation of the tool.
Figure 6:
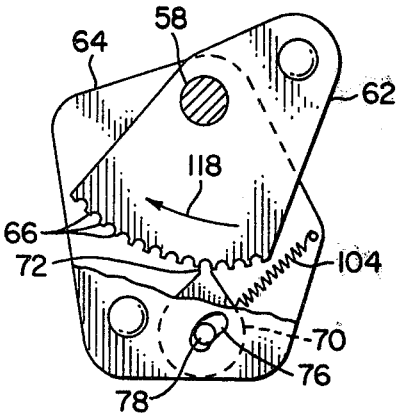
FIG. 6 is a plan view, partly cut away and partly in section, of the full stroke compelling mechanism of the device of FIG. 1 showing the relationship of the parts thereof during another phase of the operation of the tool.
Figure 7:
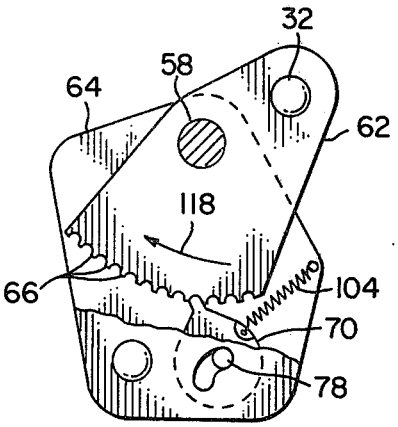
FIG. 7 is a plan view, partly cut away and partly in section, of the full stroke compelling mechanism of the device of FIG. 1 showing the relationship of the parts thereof in yet another phase of the operation of such tool.
Figure 8:
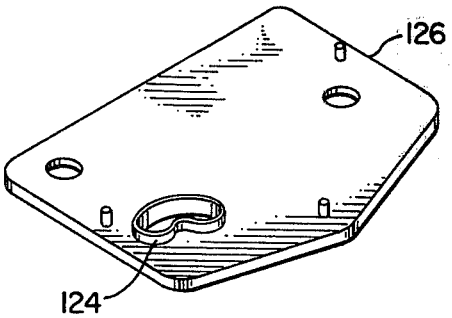
FIG. 8 is a perspective view of a further embodiment of a pawl guide for a full stroke compelling mechanism constructed in accordance with the concepts of the invention.

FIGS. 3 through 7 show the relative relationships between the ratchet means 62 and the pawl means 70 during various phases of operation of the tool 20. FIG. 3 shows the relative dispositions of the ratchet means 62 and the pawl means 70 during the closing stroke of the handle means 26 and 28, that is, when the handle means are brought together to cause a corresponding closure of the jaw means 22 and 24. In this portion of the tool cycle, the ratchet means 62 is caused to rotate about the pivot pin 58 in a clockwise direction, as viewed in FIG. 3, and as indicated by the arrow 118. The slotted openings 74 and 76, only one of which is visible in FIG. 3, are so spaced from the teeth 66 of the ratchet means 62 as to cause the nose portion 72 of the pawl means 70 to engage the teeth 66 at an inclined angle relative to an axis bisecting the pawl means pin 78 and the ratchet means pivot pin 58. The nose portion 72 of the pawl means 70 is held in engagement with respective ones of the teeth 66 of the ratchet means 62 by the torque exerted on the pawl means 70 through the action of the extension spring 104 which also pulls the pawl means 70 towards the upper right hand edge of the slotted openings 74 and 76, as viewed in FIG. 3, causing the pawl means pin 78 to abut the edge of the openings 74 and 76 in the manner shown in FIG. 3. In the event a reversal of direction of the handle means 26 and 28 is attempted while the pawl means 70 and the ratchet means 62 are in the relative positions shown in FIG. 3, the inclined position of the pawl means 70 causes a binding or locking action to occur which prevents the ratchet means 62 from moving in a direction opposite to that indicated by the arrow 118. To insure that the pawl means 70 will not shift downwardly along the slotted openings 74 and 76 during such attempted reversal of the handle means 26 and 28, the slotted openings 74 and 76 are formed to lie along an axis which is substantially perpendicular to and intersects an axis drawn through the pawl means pivot pin 78 and the pawl means nose portion 72 as the pawl means is oriented in the position shown in FIG. 3 during the jaw closure stroke. Thus, the pawl means pivot pin 78 is forced against the lower edge of the upper end of each of the slotted openings 74 and 76, as viewed in FIG. 3, so that the force exerted by the ratchet teeth 66 on the pawl means 70 is counteracted by an opposing force colinear therewith. Accordingly, the closure stroke must be completed, as shown in FIG. 4, to permit the nose portion 72 of the pawl means 70 to disengage from the teeth 66 by traversing all of the teeth 66 and confronting the side edge 120 of the ratchet means 62. The torque produced by the spring 104 is thus operative to rotate the pawl means 70 in a clockwise direction, as viewed in FIG. 4, while still holding the pawl means pin 78 against the upper right hand edge of the slotted opening 76. At this stage of the operation of the tool 20, the jaw means 22 and 24 have reached their fully closed position, or any other closed or semi-closed relationship in accordance with a predetermined adjustment (not shown) and the handle means 26 and 28 may now be moved in a reverse or jaw opening direction which will cause the ratchet means 62 to move in a counterclockwise direction, as viewed in FIG. 5, about the pin 58, and as indicated by the arrow 122 in FIG. 5. It will be noted that the pawl means 70 has assumed an inclined position relative to the axis bisecting the pin 78 and the pin 58 opposite to that which is shown in FIG. 3 so that the ratchet means 62 may rotate freely in the direction indicated by the arrow 122 while the nose portion 72 of the pawl means 70 rides along the ratchet means teeth 66. At any point during this phase of the jaw opening cycle of the tool 20, that is, while the pawl means 70 is inclined in the direction shown in FIG. 5 and the nose portion 72 is in corresponding engagement with the ratchet means teeth 66, the direction of movement of the handle means 26 and 28 may be reversed and the jaw closure portion of the cycle re-initiated simply by exerting a closing force on the handle means 26 and 28 which tends to rotate the ratchet means 62 in the direction shown by the arrow 118 in FIG. 6. The teeth 66 of the ratchet means 62 thus bear against the nose portion 72 of the pawl means 70 forcing the pawl means pin 78 to leave the upper right hand ends of the slotted openings 74 and 76 and move downwardly and to the left, as viewed in FIG. 6, along the path described by, and within the confines of, the slotted openings 74 and 76. The edges defining the slotted openings 74 and 76 thus serve as cam surfaces for the pawl means pivot pin 78. As the pawl means 70 moves or shifts from its first position as shown in FIG. 5 to a second position as shown in FIG. 6, the pawl means pivot pin 78 is caused to move away from the ratchet teeth 66 thus allowing the pawl means to shift its angle of inclination in response to the force generated on its nose portion 72 by the ratchet teeth 66 until the pawl means 70 is shifted back to its initial position as shown in FIG. 7 which is essentially duplicative of FIG. 3. In this position, the ratchet means 62 is again locked against reverse jaw opening movement by the pawl means 70 whereby the handle means 26 and 28 must again by moved to their closed position before jaw reversal can occur. At the end of the jaw closure cycle, the pawl means 70 is again shifted to the position shown in FIG. 4 and the above described sequence of operation repeated as often as necessary. The cam surfaces which define the interior boundary of the slotted openings 74 and 76, although shown as slightly curved to facilitate a smooth positional translation of the pawl means 70, may comprise straight sidewalls (not shown) having the same generally axial orientation as the slotted openings 74 and 76. Additionally, either or both of the slotted openings 74 and 76 may be replaced by a walled enclosure such as shown at 124 in FIG. 8 and located on a support plate 126 similar to the plate 64 of the tool 20 to serve as a cam surface for the pawl means pivot pin 78. It will, of course, be readily apparent to those skilled in the art that other cam surface arrangements which serve to selectively direct and guide the translational movement of the pawl means pivot pin 78 may be substituted for the embodiments shown herein without departing from the spirit of the invention and within the concepts herein disclosed.

Figure 9:
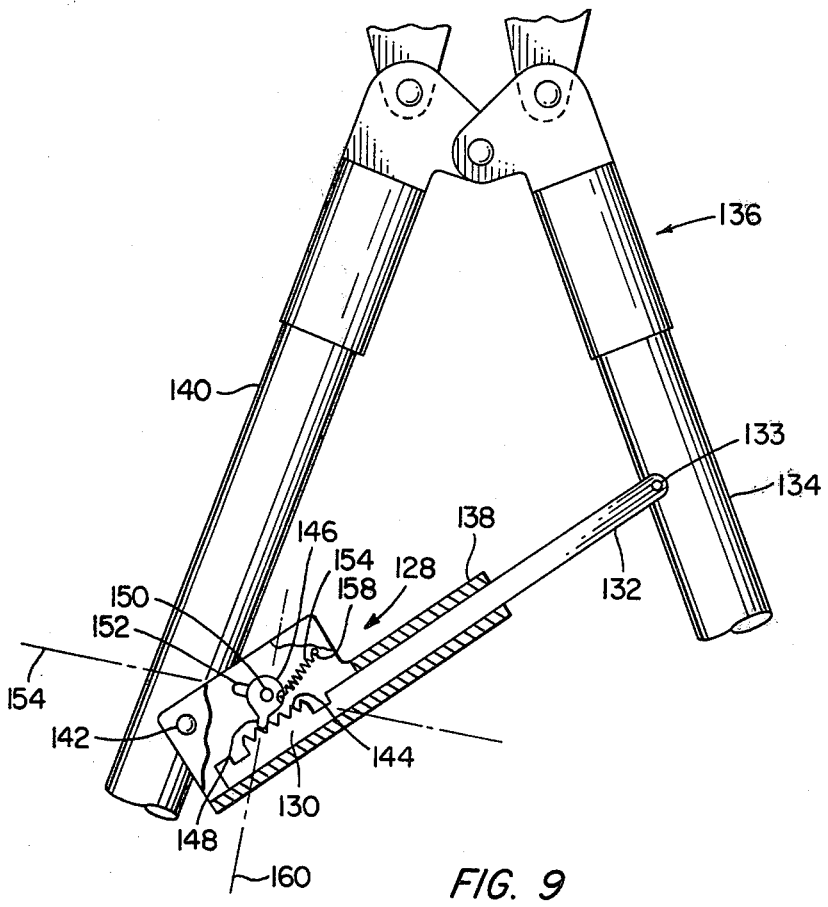
FIG. 9 is a fragmentary plan view, partly cut away and partly in section, showing a hand tool incorporating a further embodiment of a full stroke compelling mechanism constructed in accordance with the concepts of the invention.
Figure 10:
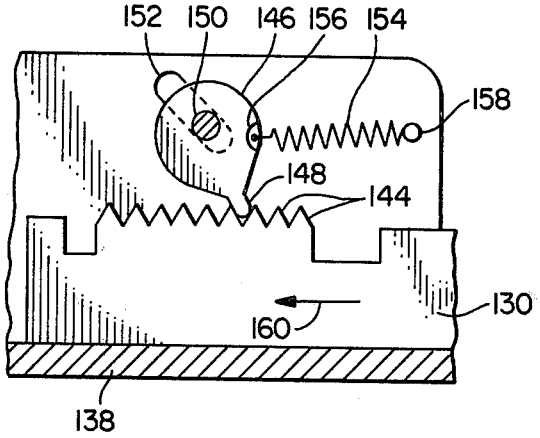
FIG. 10 is an enlarged fragmentary view, partly cut away and partly in section, showing a portion of the mechanism of FIG. 9 in another phase of the operation.

Turning now to FIGS. 9 and 10 there is shown a further embodiment of a pawl and ratchet mechanism 128 (FIG. 9) constructed in accordance with the concepts of the invention. In this embodiment, there is provided a ratchet means comprising an elongate member 130 having a first end 132 pivotally coupled at 133 to a handle member 134 of a hand tool 136 similar to tool 20. The member 130 is disposed for linear slidable movement within a support means 138 which is pivotally coupled to the other handle member 140 at 142. The member 130 is provided with ratchet teeth 144 which are arranged for engagement with a pawl means 146 similar to pawl means 70 and having a nose portion 148 and pivotable about a pawl means pivot pin 150 which is located in a slotted opening 152 in the support means 138. The slotted opening 152 is essentially duplicative of the openings 74 and 76 and similarly operate to guide and direct the translationalmovement of the pawl means 146. Biasing means shown as an extension spring 154 similar to spring 104 is coupled to the pawl means 146 at 156 (FIG. 10) and to the support means 138 at 158 to exert a force urging the pawl means 146 against the lower right edge of the slotted opening 152, as viewed in FIGS. 9 and 10. In FIG. 9, the pawl means 146 is shown inclined along an axis of inclination 160 substantially perpendicular to the inclination of the slotted opening 152 which is defined by the axis line 154. The position of the pawl means 146 is shown relative to the member 130 in FIG. 9 during the jaw closure portion of the tool stroke and is so positioned in the slotted opening 152 as to prevent the opening of the handle members 134 and 140 until full jaw closure is accomplished. In FIG. 10, the pawl means 146 is shown as rotated to a second position under the influence of spring 154 wherein its angle of inclination has shifted from the position shown in FIG. 9 upon the completion of the closure stroke and the reversal of movement or opening of the handle members 134 and 140. It should be noted that the respective angles of inclination of the pawl means 146 relative to the slotted opening 152 in both the jaw opening and jaw closing phases of operation of the tool 36 are essentially identical to that described above with respect to the embodiment shown in FIGS. 1 through 7. In the event the handle members 134 and 140 are now subjected to a reversing force tending to move them together when the pawl means 146 and the ratchet member 130 are in the relative positions shown in FIG. 10, the member 130 tends to move in the direction shown by the arrow 160 in FIG. 10 and the force of the ratchet teeth 144 against the pawl means nose portion 148 causes the pawl means pivot pin 150 to move away from the teeth 144 along the path described by the slotted opening 152 in a manner similar to that described above with respect to the arrangement shown in FIG. 6. Continued movement of the handle members 134 and 140 in a jaw closing direction will cause the pawl means 146 to shift back from the angle of inclination shown in FIG. 10 to that shown in FIG. 9 thereby re-instituting the full stroke compelling action and recommitting to tool 136 to full closure before handle reversal can be accomplished.

It will be apparent to those skilled in the art that various modifications in the shape and movement of the pawl means and ratchet means may be made without departing from the spirit of the invention and within the concepts herein disclosed and that the embodiments shown and described are intended to be exemplary only and not in limitation of the full scope and intent of the instant invention.

The embodiments of the invention in which an exclusive property or privilege is claimed are defined as follows:

1. In a tool of the type having jaw means driven by handle means which are coupled to a full-stroke compelling mechanism having cooperatively coupled ratchet means and pawl means wherein said ratchet means includes a toothed portion and is coupled to one of said handle means and said pawl means is coupled to the other of said handle means and has a nose portion spring biased into selective engagement with said toothed portion of said ratchet means to provide free movement of said handle means in a jaw closing direction while resisting the reverse movement of said handle means before completion of the jaw closing stroke the improvement comprising: means for slidably shifting said pawl means along a predetermined path towards and away from said ratchet means in response to a predetermined direction of movement of said ratchet means, said ratchet means being movable in a first direction corresponding to the closing of said jaw means and in a second direction corresponding to the opening of said jaw means, said pawl means assuming a first inclination relative to said toothed portion of said ratchet means when said ratchet means is moved in said first direction and assuming a second inclination relative to said toothed portion of said ratchet means when said ratchet means is moved in said second direction, said means being arranged to shift said pawl means away from said ratchet means and from said second inclination to said first inclination when said ratchet means is moving in said second direction and is subjected to a force tending to reverse its direction of movement, said predetermined path being substantially perpendicular to the axis of said first inclination of said pawl means and substantially parallel to the axis of said second inclination of said pawl means.

2. The improvement as defined in claim 1 wherein said fullstroke compelling mechanism includes support means for said pawl means and said ratchet means, and said means is carried by said support means.

3. The improvement as defined in claim 2 wherein said means includes a cam surface carried by said support means for directing the path of said pawl means.

4. The improvement as defined in claim 3 wherein said pawl means includes pivot means slidably engageable with said cam surface.

5. The improvement as defined in claim 1 wherein said means includes a support means for both said pawl means and said ratchet means, said support means further including a cam surface engaged by said pawl means.

6. The improvement as defined in claim 5 wherein said pawl means comprises a pivot pin engageable with said cam surface.

7. The improvement as defined in claim 1 wherein said ratchet means is movable in an arcuate path.

8. The improvement as defined in claim 1 wherein said ratchet means is movable along a linear path.

* * * * *